United States Patent [19]

Szarka

[11] 4,421,165

[45] Dec. 20, 1983

[54] MULTIPLE STAGE CEMENTER AND CASING INFLATION PACKER

[75] Inventor: David D. Szarka, Duncan, Okla.

[73] Assignee: Halliburton Company, Duncan, Okla.

[21] Appl. No.: 169,095

[22] Filed: Jul. 15, 1980

[51] Int. Cl.[3] ..... F21B 33/13

[52] U.S. Cl. ..... 166/151; 166/187; 166/289

[58] Field of Search ..... 166/182, 289, 151

[56] References Cited

U.S. PATENT DOCUMENTS

| | | | |
|---|---|---|---|
| 3,223,160 | 12/1965 | Baker | 166/27 |
| 3,228,473 | 1/1966 | Baker | 166/154 |
| 3,247,905 | 8/1966 | Baker | 166/194 |
| 3,270,814 | 9/1966 | Richardson et al. | 166/21 |
| 3,524,503 | 8/1970 | Baker | 166/187 |
| 3,529,665 | 9/1970 | Malone | 166/187 |
| 3,768,556 | 10/1973 | Baker | 166/224 X |
| 3,768,562 | 10/1973 | Baker | 166/289 |
| 3,941,190 | 3/1976 | Conover | 166/187 |
| 3,948,322 | 4/1976 | Baker | 166/289 |

*Primary Examiner*—James A. Leppink
*Assistant Examiner*—Thuy M. Bui
*Attorney, Agent, or Firm*—Lucian Wayne Beavers; Joseph A. Walkowski; Thomas R. Weaver

[57] ABSTRACT

A combination multiple stage cementing tool and casing inflation packer includes an inflatable packer having a packer mandrel and an inflatable packing element disposed about the mandrel. A cementing tool includes a cylindrical outer casing, a cementing port disposed through a side wall of the casing, and a sliding sleeve valve assembly for opening and closing the cementing port. The cylindrical outer casing of the cementing tool is permanently attached to the packer mandrel and has a maximum outer diameter at least as great as a maximum outer diameter of the inflatable packing element when the inflatable packing element is in an uninflated position.

1 Claim, 5 Drawing Figures

MULTIPLE STAGE CEMENTER AND CASING INFLATION PACKER

The present invention relates generally to downhole tools for conducting cementing operations, and more particularly, but not by way of limitation, to such apparatus constructed for use in multiple stage cementing of the annulus between a well casing and a well borehole.

In preparing oil well bore holes for oil and/or gas production, a most important step involves the process of cementing. Basically, oil well cementing is the process of mixing a cement and water slurry and pumping it down steel casing to critical points located in the annulus around the casing, in the open hole below, or in fractured formations.

Cementing a well protects possible production zones behind the casing against salt water flow and protects the casing against corrosion from subsurface mineral waters and electrolysis from outside. Cementing also eliminates the danger of fresh drinking water and recreational water supply strata being contaminated by oil or salt water flow from formations containing those substances. It further prevents oil well blowouts and fires caused by high pressure gas zones behind the casing and prevents collapse of the casing from high external pressures which can build up underground.

A cementing operation for protection against the above described downhole conditions is called primary cementing. Secondary cementing includes the cementing processes used in a well during its productive life, such as remedial cementing and repairs to existing cemented areas. The present invention is most useful in primary cementing operations.

In the early days of oil field production, when wells were all relatively shallow, cementing was accomplished by flowing the cement slurry down the casing and back up the outside of the casing in the annulus between the casing and the borehole wall.

As wells were drilled deeper and deeper to locate petroleum reservoirs, it became difficult to successfully cement the entire well from the bottom of the casing, and therefore, multiple stage cementing was developed to allow the annulus to be cemented in separate stages, beginning at the bottom of the well and working upwardly.

Multiple stage cementing is achieved by placing cementing tools, which are primarily valve ports, in the casing or between joints of casing at one or more locations in the borehole. Cement is then flowed through the bottom of the casing and up the annulus to the lowest cementing tool in the well. Then the bottom of the casing string is closed off and the cementing tool is opened. Cement can then be flowed through the cementing tool up the annulus to the next cementing tool, thereby completing the second stage of cementing. Additional stages of cementing may be similarly accomplished by the use of additional cementing tools.

In performing multiple stage cementing, it is sometimes desirable to have an inflatable casing packer located directly below the cementing tool. After the first stage cementing is accomplished, the inflatable packer is inflated approximately at the upper limit of the cement defining the first stage of cement, and then the cementing tool is opened to accomplish the second stage of cementing.

The prior art has included combination cementing tools with inflatable packers located therebelow. Such tools are shown, for example, in U.S. Pat. No. 3,524,503 and U.S. Pat. No. 3,948,322, both to Baker and assigned to the assignee of the present invention.

Furthermore, such tools have been used wherein the inflatable packer has an inflatable packing element which includes a cylindrical solid wall metal tubular bladder membrane located within an elastomeric bladder. This is shown in U.S. Pat. No. 3,948,322.

The prior art also includes cementing tools very similar to the cementing tool used in the combination tool of the present invention. The cementing tool utilized in the combination tool of the present invention is substantially similar to that shown in U.S. Pat. No. 3,768,556 to Baker and assigned to the assignee of the present invention.

Other cementing tools are shown in U.S. Pat. Nos. 3,768,562; 3,247,905; 3,228,473 and 3,223,160, all to Baker and assigned to the assignee of the present invention.

Additionally, a cementing packer is shown in U.S. Pat. No. 3,270,814 to Richardson, et al. and assigned to the assignee of the present invention.

The combination multiple stage cementer and casing inflation packer of the present invention provides numerous advantage over combination cementers and packers of the prior art, or separate cementers and packers of the prior art used in combination.

One particular problem with any downhole tool is that the maximum outside diameter of the tool is limited by the inner diameter of the well bore within which the tool is run, and the minimum inner diameter is generally also limited by the desire to retain the capability of running other tools down through the casing string. Often the minimum internal bore must be maintained, and the manner of construction of the particular downhole tool therefore determines the outside diameter of the tool. The thinner the wall can be kept, the smaller the outer diameter of the tool will be and subsequently, the easier it will be to manipulate in the well bore. In combination cementing tools and packers of the prior art and in tool strings made up of separate packers and cementing tools, the largest outside diameter of the two components has always been the outside diameter of the inflatable packer which was greater than the outside diameter of the cementing tool.

The present invention provides a combination cementing tool and packer which minimizes the outside diameter of the inflatable packing element so that it is equal to or less than the outside diameter of the cementing tool itself. This allows the combination tool to be run in smaller diameter well bore holes than can combination cementing tools and inflatable packers of the prior art.

Additional advantages are provided in that it is more economical to manufacture and use a single combination tool like that of the present invention as compared to two separate tools which would have to be made up in the field on the casing string.

BRIEF DESCRIPTION OF THE INVENTION

The present invention includes an inflatable packer which has a packer mandrel and an inflatable packing element disposed about the packer mandrel. Also included is a cementing tool which has a cylindrical outer casing, a port means disposed through a side wall of the casing, and valve means for opening and closing the port means. The cylindrical outer casing is permanently attached to the packer mandrel and has a maximum outer diameter at least as great as a maximum outer diameter of the inflatable packing element when the inflatable packing element is in an inflated position.

Numerous objects, features and advantages of the present invention will be readily apparent to those skilled in the art upon a reading of the following disclosure when taken in conjunction with the accompanying drawings.

DETAILED DESCRIPTION

Figure 1A:
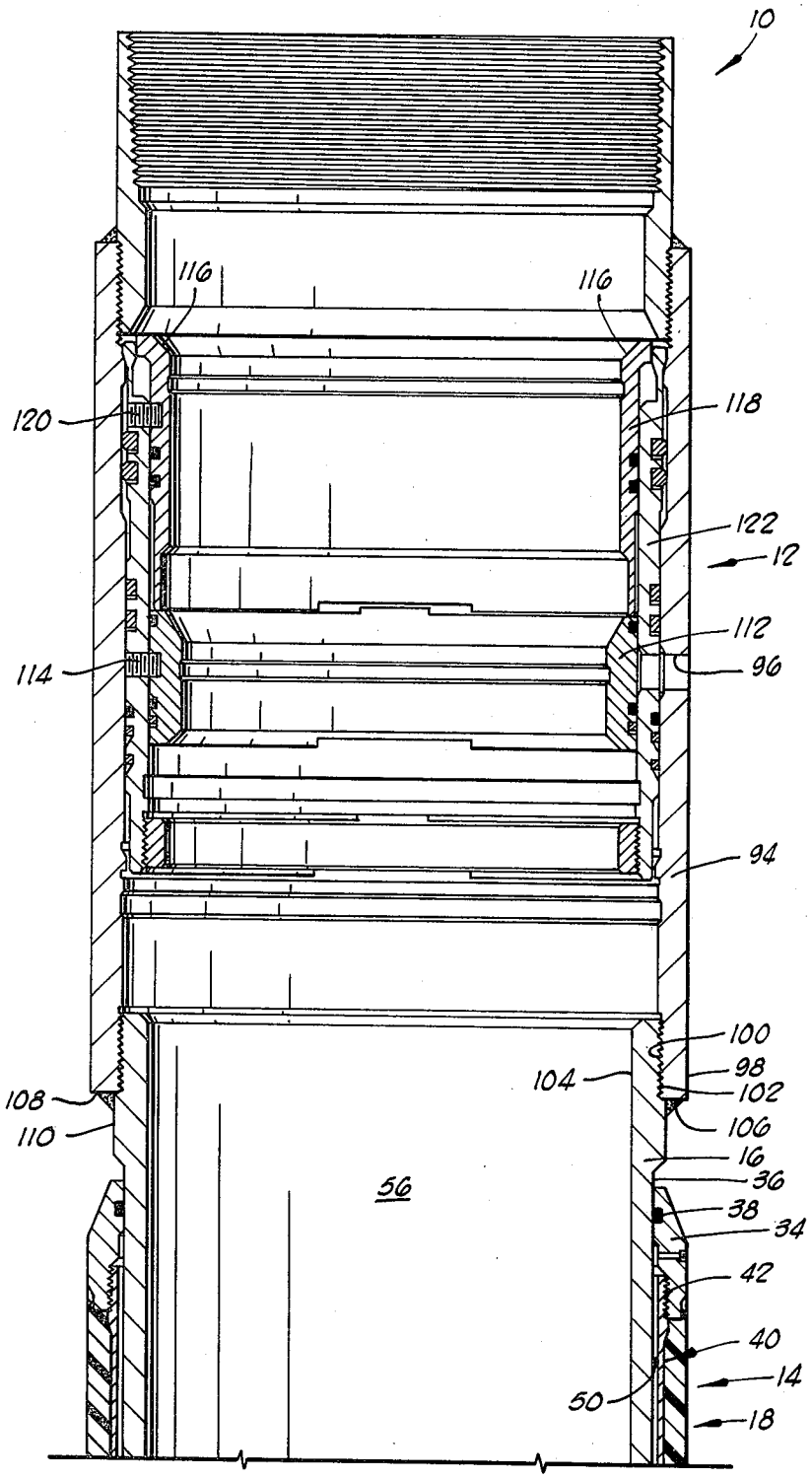
FIGS. 1A and 1B comprise a section elevation view of the combination cementing tool and inflatable packer of the present invention.
Figure 1B:
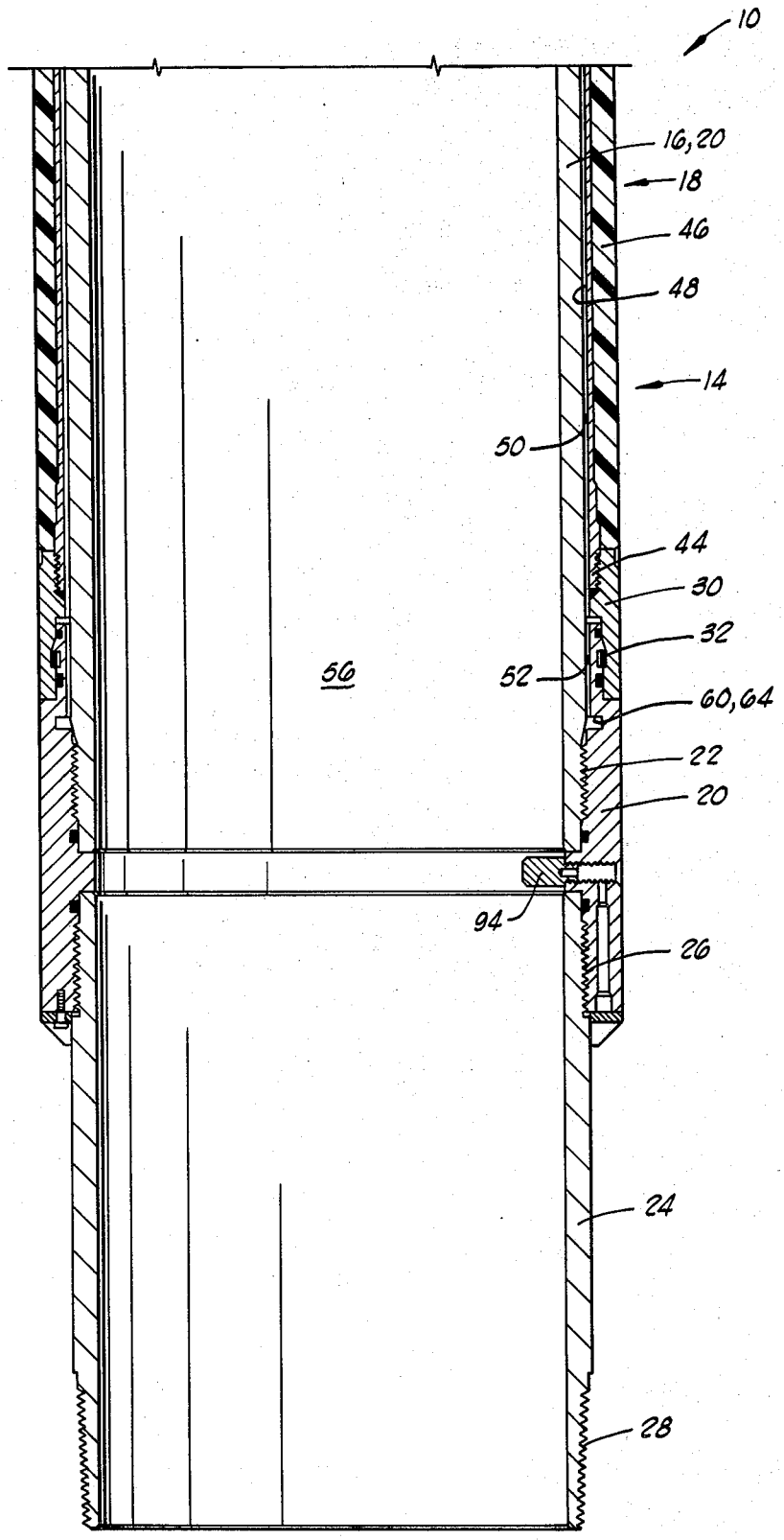

Referring now to the drawings, and particularly to FIGS. 1A and 1B, the combination cementing tool and inflatable packer of the present invention, which may generally be referred to as a well tool, is shown and generally designated by the numeral 10. The well tool 10 includes a cementing tool 12 and an inflatable packer 14.

The inflatable packer 14 includes a packer mandrel 16 and an inflatable packing element generally designated by the numeral 18 which is disposed concentrically about the mandrel 16.

Connected to a lower end of packer mandrel 16 is an inflation valve body 20 which is attached to packer mandrel 16 at threaded connection 22. A lower adapter body 24 is attached to inflation body 20 at threaded connection 26. Lower adapter body 24 has a threaded lower end 28 for attachment to a portion of a casing string (not shown) located therebelow. The inflatable packing element 18 includes an annular fixed shoe 20 which is fixedly connected to the packer mandrel 16 by means of annular locking ring 32 which attaches shoe 30 to valve body 20.

An annular sliding shoe 34 is concentrically disposed about an outer cylindrical surface 36 of packer mandrel 16 with a sliding seal being provided therebetween by annular O-ring 38.

A cylindrical tubular bladder membrane 40 is connected between fixed shoe 30 and sliding shoe 34. The bladder membrane 40 is made of a metal such as aluminum, aluminum alloy, steel or stainless steel. The membrane 40 is a relatively thin, tubular solid or impervious membrane the physical properties of which permit an intermediate portion of the membrane between its upper and lower ends 42 and 44 to expand without rupture during the inflation of the inflatable packer 14.

An elastomeric bladder 46 is connected between fixed shoe 30 and sliding shoe 34 and is concentrically disposed about bladder membrane 40 and is bonded thereto.

An inner cylindrical surface 48 of bladder membrane 40 is spaced radially outward from outer cylindrical surface 36 of packer mandrel 16 so as to form an annular inflation space 50 therebetween.

An inflation passage 52 communicates annular inflation space 50 with inflation valve body 20.

Figure 2:
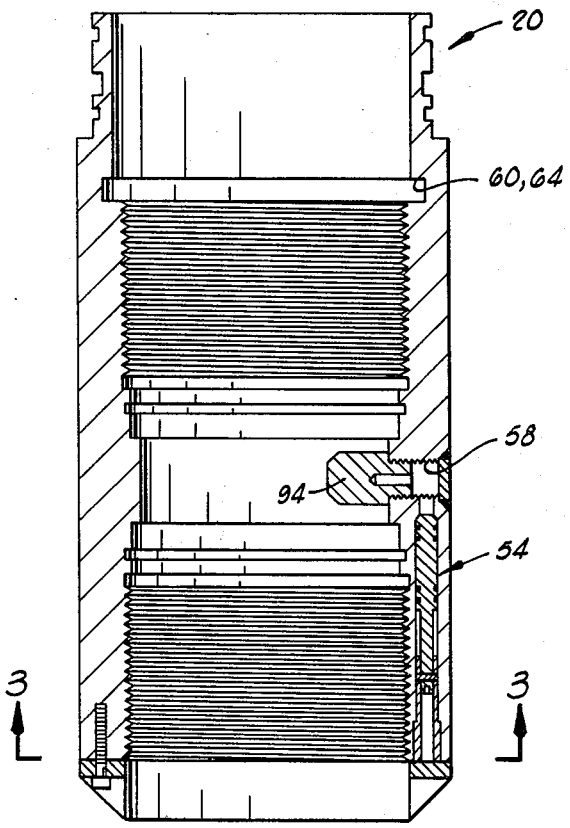
FIG. 2 is a section elevation view of an inflation valve body of the inflatable packer of FIG. 1B.

The inflation valve body 20 is best shown in FIG. 2. The inflation valve body 20 includes an inflation valve means 54 for communicating inflation passage means 52 with an inner bore 56 of packer mandrel 16.

The inflation valve means 54 is preferably constructed similar to the valve disclosed in U.S. patent application No. 048,977 of Eugene E. Baker and Ernest E. Carter, Jr., filed June 15, 1979 and assigned to the assignee of the present invention.

The inflation valve means 54 includes an inlet 58 for communicating with inner bore 56 of packer mandrel 16. Valve 54 also includes an outlet passage 60 for communicating with inflation passage 52. The outlet passage 60 includes a longitudinal portion 62 and an upper annular portion 64.

A first bore 66 is disposed in valve body 20 for communicating the inlet 58 with the annulus between the well tool 10 and the oil well bore hole. That communication is accomplished at the lower end 68 of bore 66.

A second bore 70 is disposed in valve body 20 and is also communicated with the annulus between the well tool 10 and the oil well borehole at its lower end 72.

A first port means 74 connects the first and second bores 66 and 70, and a second port means 76 connects the second bore 70 with the outlet 60.

Figure 4:
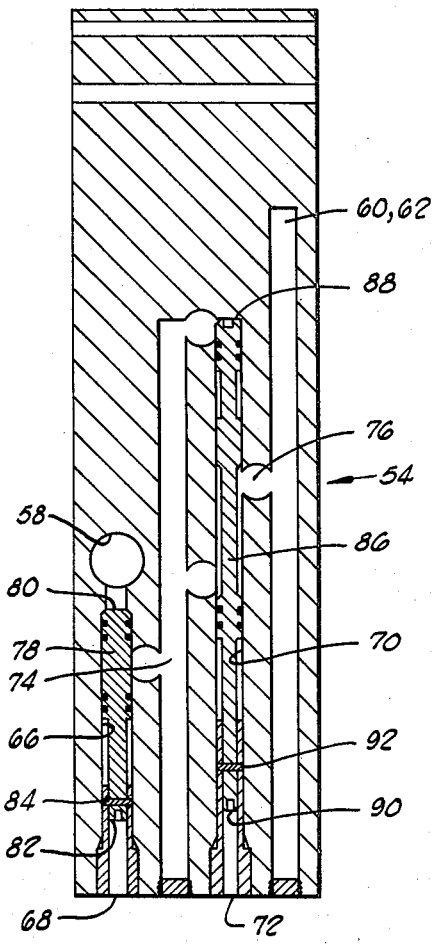
FIG. 4 is a laid-out section view along line 4—4 of FIG. 3.

A first piston 78 is disposed in the first bore 66 and has its first and second ends 80 and 82 arranged for fluid communication with inlet 58 and the annulus, respectively. The first piston 78 is movable between a first position, as shown in FIG. 4, blocking first port means 74, and a lower second position allowing fluid communication between inlet 58 and first port means 74.

A shear pin 84 provides a means for holding first piston 78 in its said first position until a fluid pressure differential between inner bore 56 of packer mandrel 16 and the annulus outside of the well tool 10 reaches a first predetermined level, e.g. 1000 psi, and for releasing the first piston 78 so that it may be moved to its second position when said pressure differential reaches said first level.

A second piston 86 is disposed in the second bore 70 and has first and second ends 88 and 90 arranged for fluid communication with first port means 74 and the annulus, respectively. The second piston 86 is movable between a first position, as shown in FIG. 4, allowing fluid communication between first port means 74 and second port means 76, and a second downwardly displaced position blocking second port means 76.

A shear pin 92 provides a means for holding the second piston 86 in its said first position until said fluid pressure differential reaches a second predetermined level, e.g. 1500 psi, said second predetermined level being higher than said first predetermined level, and for releasing the second piston 86 so that it may be moved to its said second position blocking second port means 76 when said pressure differential reaches said second predetermined level.

A knockout plug 93 is threadedly engaged with inlet 58 to initially block inlet 58.

The cementing tool 12 includes a cylindrical outer casing 94 which has one or more cementing port means 96 disposed through a side wall thereof.

Casing 94 has a lower end 98 which has an internally threaded portion 100.

An externally threaded portion 102 of an upper end 104 of packer mandrel 16 is threadedly attached to the threaded internal portion 100 of casing 94. The casing 94 and packer mandrel 16 are permanently attached by means of an annular fillet weld 106 between an end face 108 of lower end 98 of casing 94 and an outer cylindrical surface 110 of packer mandrel 16 adjacent the externally threaded portion 102 of the upper end 104 thereof.

By permanently attaching the casing 94 and packer mandrel 16 so as to make a unitary one-piece well tool 10, several advantages are provided over separate cementing tools and over inflatable packers which must be assembled at the well site.

If separate cementing tools and inflatable packers are used, the upper end of the packer mandrel above the inflatable packing element must extend for a distance of approximately three feet so that the threaded joint with the cementing tool can be made up. This is eliminated by the present invention which allows approximately three feet to be eliminated from the length of the packer mandrel as compared to separate inflatable packers. Additionally, this minimizes the distance between cementing ports 96 and the inflatable packer element 18 so as to minimize the length of that corresponding portion of the annulus between the oil tool 10 and the oil well bore hole which might be imperfectly filled with cement if the first stage of cementing is not extended sufficiently to flow the cement continuously past cementing ports 96.

The maximum outer diameter of the casing 94 is at least as great as the maximum outer diameter of the inflatable packing element 18. This is contrasted to prior art designs where the inflatable packer has always been of greater diameter than the cementing tool with which it was used. This allows the combination tool of the present invention to be used in smaller diameter well boreholes than could prior art devices discussed previously.

The relatively thin solid metal tubular membrane 40 in combination with an elastomeric bladder 46 bonded to the outside thereof provides a relatively thinner inflatable packing element than most any other available design and therefore when used in combination with the other components of the present invention allows the maximum outside diameter of the inflatable packing element 18 to be maintained at a diameter no greater than a maximum outer diameter of the casing 94.

The manner of operation of the well tool 10 of the present invention is as follows.

Figure 3:
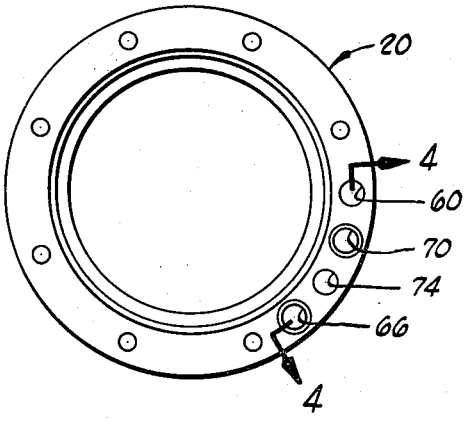
FIG. 3 is a section view along line 3—3 of FIG. 2.

The well tool 10 including the cementing tool 12 and the inflatable packer 14 are placed within a casing string and lowered into position within an oil well bore hole in a manner similar to that shown in FIGS. 3 through 5 of U.S. Pat. No. 3,948,332 to Baker, which is incorporated herein by reference.

The first stage of cementing is accomplished by pumping cement down the casing string out the bottom thereof and back up through the annulus between the casing string and the oil well borehole to a level slightly above the cementing tool 12 of the present invention.

A first stage shut off plug is pumped down the casing string on top of the first stage of cement using a displacement fluid, generally water or mud. As the shut off plug passes through the well tool 10 it engages the knockout plug 93 and shears off the same thereby opening the inlet 58 of the inflation valve means 54. Then the shut off plug moves downward below the well hole tool 10 and bottoms out on a shut off baffle located in a float collar or in a bottom shoe of the casing string.

Then the pressure within the casing string is increased to the first predetermined level of pressure differential between the inside of the casing string and the outer annulus so that the first piston 78 of inflation valve means 54 is moved downward thereby communicating the inner bore 56 of power mandrel 16 with the inflation passage 52 by flowing through bore 66, first port means 74, around second piston 86 within the second bore 70, through second port means 76 and out the outlet 60 of inflation valve means 54. The displacement fluid then flows to the inflatable packer 14 thereby inflating the same.

The packer 14 is inflated immediately upon completion of the first stage of cement. This is contrasted to a device like that of U.S. Pat. No. 3,948,322 where the inflation and cementing valves are combined so that the packer is not inflated until an opening plug opens the cementing valve. In such a device there is a lag time between seating of the shut off plug, and the opening of the cementing valve by the opening plug.

The pressure within inner bore 56 of the packer mandrel 16 is increased to a second predetermined level and at that point the second piston 86 moves downward to a position closing second port means 76 of inflation valve means 54 so that the inflation space 50 of inflatable packer 14 is no longer in communication with the inner bore of the casing string, trapping full inflation pressure within inflation space 50.

The first and second predetermined pressure levels may be varied by varying the construction of the shear pins 84 and 92, respectively.

Then an opening plug is dropped into the casing string and it free-falls into engagement with a cementing valve opening sleeve 112 of cementing tool 12. The pressure within the casing string above the opening plug is increased until one or more shear pins 114 shear allowing the opening sleeve 112 to be moved downward opening cementing ports 96. Then the second stage of cementing can be accomplished by pumping cement down the casing string and through the cementing ports 96 into the annulus and back up the annulus.

When the second stage of cementing is completed and it is desired to close cementing ports 96 a closing plug is pumped down the casing string on top of the second stage of cement using a displacement fluid, and landed on an upward facing shoulder 116 of a cementing valve closing sleeve 118.

Once again, pressure is increased within the casing string until one or more shear pins 120 shear thereby releasing the closing sleeve 118 so that it moves downward carrying with it an intermediate sleeve 122 thereby closing the cementing ports 96.

The manner of operation of a cementing tool such as the cementing tool 12 is described in greater detail in U.S. Pat. No. 3,768,556 to Baker, which is incorporated herein by reference.

Thus, it is seen that the combination multiple stage cementer and casing inflation packer of the present invention is readily adapted to achieve the ends and advantages mentioned as well as those inherent therein. While certain specific embodiments of the present invention have been illustrated for the purpose of this disclosure, numerous changes in the arrangement and construction of parts may be made by those skilled in the art, which changes are encompassed within the scope and spirit of this invention as defined by the appended claims.

What is claimed is:

1. A well tool for use in stage cementing a well bore, comprising:

a substantially tubular cementing tool operated by an opening and a closing cementing plug, including a cylindrical outer casing, cementing ports disposed through the side wall of said casing, an upper adapter of lesser external diameter than said casing and permanently secured thereto, an annular opening sleeve disposed adjacent said ports in said casing and secured in place by shear means, an annular closing sleeve above said opening sleeve and concentric therewith, an intermediate sleeve surrounding said opening sleeve and said closing sleeve and secured to said closing sleeve by shear means, said intermediate sleeve having substantially the same internal diameter as said upper adapter, said casing and said sleeves defining an open bore through said cementing tool;

a substantially tubular packer mandrel of lesser external diameter than said casing and permanently secured thereto, said packer mandrel having substantially the same internal diameter as said upper adapter;

an inflatable packing element disposed about said packer mandrel, said packing element including an annular sliding shoe at the upper end of said packer mandrel, an annular fixed shoe at the lower end of said packer mandrel, a tubular solid wall metal bladder membrane secured to said shoes and disposed therebetween about said packer mandrel, and an elastomeric bladder disposed around said membrane and extending between said shoes;

a valve body containing a packer inflation valve in the wall thereof and secured to the lower end of said packer mandrel, said valve body being of substantially the same external diameter as said fixed shoe to which it is secured, and of substantially the same internal diameter as said mandrel;

a lower adapter of substantially the same internal diameter as said packer mandrel and of lesser external diameter than said casing, secured to said valve body and concentric therewith; and knockout plug means blocking an inflation passage leading to said inflation valve, and adapted to break off from said valve body and fall to a level in the well bore below said well tool;

said inflatable packing element having a maximum external diameter in an uninflated state no greater than that of said casing, and said upper adapter, said intermediate sleeve, said mandrel, said valve body and said lower adapter defining a substantially constant diameter bore through said well tool, whereby an unobstructed bore of said substantially constant diameter may be obtained through the entirety of said well tool after a cementing operation by the drilling out of said opening sleeve, said closing sleeve and said plugs.

* * * * *

UNITED STATES PATENT AND TRADEMARK OFFICE

CERTIFICATE OF CORRECTION

PATENT NO. : 4,421,165

DATED : Dec. 20, 1983

INVENTOR(S) : David D. Szarka

It is certified that error appears in the above-identified patent and that said Letters Patent is hereby corrected as shown below:

In column 2, line 25, delete the word [advantage] and insert therefor --advantages--.
In column 3, line 40, delete the numeral [20] and insert therefor --30--.

Signed and Sealed this

*Eighth* Day of *May 1984*

[SEAL]

*Attest:*

GERALD J. MOSSINGHOFF

*Attesting Officer*

*Commissioner of Patents and Trademarks*